US010603759B1

(12) United States Patent
Imre

(10) Patent No.: US 10,603,759 B1
(45) Date of Patent: Mar. 31, 2020

(54) FORM-FOLLOWING ROTARY BIT FOR IMPROVED GRINDING, SANDING, BUFFING AND THE LIKE

(71) Applicant: Csaba Imre, Visalia, CA (US)

(72) Inventor: Csaba Imre, Visalia, CA (US)

( * ) Notice: Subject to any disclaimer, the term of this patent is extended or adjusted under 35 U.S.C. 154(b) by 360 days.

(21) Appl. No.: 14/168,869

(22) Filed: Jan. 30, 2014

(51) Int. Cl.
*B24D 13/14* (2006.01)
*B24B 23/02* (2006.01)

(52) U.S. Cl.
CPC ..... *B24B 23/022* (2013.01); *B24D 13/14* (2013.01); *B24B 23/028* (2013.01)

(58) Field of Classification Search
CPC ..... B24D 13/14
USPC ..... 451/510, 508, 490
See application file for complete search history.

(56) References Cited

U.S. PATENT DOCUMENTS 2,531,775 A * 11/1950 Kenerson ..... B24B 45/00 451/510
2,991,596 A * 7/1961 Walters ..... B24B 23/04 132/73.6
3,707,059 A * 12/1972 Burtch ..... B24D 9/08 451/490
3,858,368 A * 1/1975 Cocherell ..... A61C 3/06 433/127
4,055,897 A * 11/1977 Brix ..... A61C 3/06 433/166
6,517,423 B2 * 2/2003 Ueno ..... B24B 23/02 451/359

* cited by examiner

*Primary Examiner* — Robert A Rose
(74) *Attorney, Agent, or Firm* — Richard A. Ryan

(57) ABSTRACT

A rotary bit for use with a rotary tool to improve grinding, sanding, buffing, polishing and like operations on a work object. The rotary bit is structured and arranged to flex when it comes into contact with round, curved and other shaped surfaces of the work object to prevent damage to those surfaces and the areas adjacent thereto. The rotary bit comprises a flexible member that fixedly or detachably mounts to one end of an elongated shaft of a mandrel that fits into and is rotated by the rotary tool. The flexible member has a compressible body with a cap member at the proximal end to provide stiffness and grit paper attached, either fixedly or removably, at the distal end to accomplish the desired work operations. The rotary bit can use different materials for the compressible body and different abrasive materials to accomplish the work operations.

20 Claims, 5 Drawing Sheets

FORM-FOLLOWING ROTARY BIT FOR IMPROVED GRINDING, SANDING, BUFFING AND THE LIKE

CROSS-REFERENCE TO RELATED APPLICATIONS

None.

STATEMENT REGARDING FEDERALLY SPONSORED RESEARCH

Not Applicable.

REFERENCE TO A SEQUENCE LISTING, A TABLE OR A COMPUTER PROGRAM LISTING APPENDIX SUBMITTED ON A COMPACT DISC

Not Applicable.

BACKGROUND OF THE INVENTION

A. Field of the Invention

The field of the present invention relates generally to rotary tools and their accessory apparatuses that are utilized to accomplish grinding, sanding, buffing and like rotary operations on a work object to transform the work object into an improved work object. In particular, the present invention relates to rotary bits that are attached to a rotary tool and rotatably driven thereby for use in performing such rotary operations. Even more particularly, this invention relates to rotary bits that are specially configured to facilitate such operations on a work object having curved surfaces without damaging the work object.

B. Background

Many people utilize powered rotary tools to accomplish a wide variety of work operations, such as drilling, grinding, sharpening, cutting, cleaning, sanding, routing, carving and engraving, on a work object with a rotary bit that is attached to and rotated by the rotary tool to transform the work object. As well known, work objects may be made out of stone, wood, metal, glass, composites or like materials. One of the most common types of rotary tools utilized by both professionals and homeowners are those rotary tools that are adaptable to being utilized with a variety of different types of rotary bits so the rotary tool may be used for different types of work operations. Examples of such rotary tools are those which are generally commercially available from Dremel, Foredom and RotoZip (among others). As well known in the art, these and other rotary tools have a rotating element, typically a chuck, collet and/or other clamping mechanism, that clamps onto and rotates the shaft of a mandrel which is attached to or integral with a drill bit, burr or other tool component to perform the desired work operation. The rotating element of the power tool rotates the tool component such that when the tool component is placed in direct contact with the work material it accomplishes the desired work operation. The rotating element of the power tools are operatively connected to a source of power that provides the necessary rotating speed and torque. Typical sources of power for such power tools include air motors that are connected to a pneumatic source and electric motors that are connected to an electrical source, which may include batteries and/or a power cord that connects to an outlet or other source of electricity. One common use for such rotary tools is for the work operation to be of the type that is generally considered finishing work, such as grinding, sanding and buffing, to improve on more basic work, such as cutting and carving, that had already been done on the work object.

With regard to many such work objects, this finishing work is of critical importance and, in fact, is often what actually makes the final work object have value. Naturally, any mistakes that are made during the finishing process are very costly with regard to the person's time and, often, with regard to the material(s) utilized as the work object. Much of the finishing work is accomplished with various types of sand, diamond grit, carbide grit or other abrasive materials (hereinafter, all such materials are collectively referred to as "abrasive materials") that are typically attached to or embedded in one side of a heavy backing paper having the abrasive material forming an abrasive outward face (hereinafter, when the abrasive material is attached to, embedded in or otherwise associated with the backing paper, the abrasive material and paper are collectively known as "grit paper"). The abrasive materials that are attached to or embedded in the grit paper are provided in a variety of different sizes, which are commonly referred to by their grit size or designation and are typically intended to accomplish different results when worked against the work material. The grit sizes are utilized to inform the person using the grit paper, at least in a general manner, the relative amounts of surface material that will be removed by the grit paper, with the larger grit sizes generally being less coarse to remove more material and the smaller grit sizes being finer to remove less material (i.e., commonly also referred to by the more general descriptions as coarse, medium, fine, extra fine and the like).

Often, the grit paper is utilized with a rotary tool to more quickly, and sometimes more precisely, apply the abrasive material thereon to the work object. With the type of rotary tools described above, typically the grit paper is attached to a rotary bit comprising a support head that is attached to or integral with a mandrel having a shaft which is received into and rotatably supported by the chuck of the rotary tool. The support head of the rotary bit is stiff to transfer the rotary motion from the rotary tool to the grit paper attached thereto. When the grit paper held by the rotary bit is pressed against the work material, the abrasive material thereon will remove some of the material from the work object, preferably as desired by the person who is working on the work object, to remove any scratches therefrom or to polish the surface of the work object. Although the stiffness of the support head has certain benefits, the stiffness of the support head can lead to problems with regard to using the rotary tool on certain work objects, problems which can lead to loss of time and loss of the work object itself. Because of these problems, many people would rather sand by hand than utilize the benefits of the rotary tool to avoid the potential loss of time and material.

One such potential problem of using a rotary tool to work grit paper against the work object is that the grit paper may remove too much material from the surface of the work object or unintentionally cut into or scrape areas of the work object that have already been worked to their desired shape and polish. This problem is particularly an issue when the user is utilizing a rotary tool to grind, sand or buff a work object having a round, curved or other shaped surface. Moving the grit paper across or next to the shaped surface must be done with care to avoid undesirably changing the shape of the shaped surface. Likewise, significant care must be utilized when using a rotary tool to apply grit paper to sand, buff or polish an area that is next to a shaped surface so the edge of the grit paper does not flatten or cut into a portion of the shaped surface. As well known in the art, if the user of the rotary tool is not particularly careful, the grit paper being rapidly rotated by the rotary tool can easily gouge or score the partially or fully finished surface of the work object. In addition to causing the user to waste time, often a significant amount of time, fixing the damage that was done to the work object, the features of the work object that have been unintentionally gouged or scored may be damaged beyond repair, resulting in loss of the entire work object and the materials and time associated with that work object.

Another potential problem with regard to the use of presently available rotary bits on certain work object materials is that the vibration from the rotary tool may be transferred to the work object. Unfortunately, many materials that are used for work objects, particularly those work objects which are intended to be art, are at least somewhat if not very sensitive to vibration forces. These vibration forces can cause the material utilized for the work object to fracture and/or develop fracture lines therein, typically resulting in loss of the work object and the time and materials associated with that work object.

Because many of the materials which are used for such purposes are quite expensive, the financial loss of the material can be significant. The loss of time that was spent on the work product until the damage was done can be both discouraging and very expensive, at least with regard to income potential from completing the work object. This loss of time is made worse because the problems associated with using the rotary tool to sand and buff the work object typically arise when the user is close to finishing the work object, resulting in loss of most of the time that was anticipated to be spent on the work product.

What is needed, therefore, is an improved rotary bit for use with rotary tools that can be utilized to accomplish one or more work operations on a work object that reduces the likelihood of causing damage to the work object which could result in loss of time or materials that are or have been associated with the work object. The new rotary bit should be structured and arranged for use with a rotary tool and abrasive materials, whether alone or as part of grit paper, to allow the user to perform a variety of grinding, sanding, buffing and like work operations on a work object in a manner that reduces the likelihood of damaging the work object while doing the work operations. Preferably, the improved rotary bit will allow the user to perform these work operations on various round, curved and other shaped surfaces of the work object with a rotary tool with less likelihood of cutting, gouging, scoring or otherwise damaging the shaped surfaces and areas adjacent to the shaped surfaces. The improved rotary bit should be structured and arranged to be utilized with a wide variety of different types of available rotary tools and with conventional grit paper and other abrasive materials. Preferably, the rotary bit will be relatively inexpensive to manufacture.

SUMMARY OF THE INVENTION

The form-following rotary bit of the present invention provides the benefits and solves the problems identified above. That is to say, the present invention discloses a rotary bit which is configured for use with a power rotary tool to provide improved grinding, sanding, buffing and like work operations on a work object. More specifically, the rotary bit of the present invention is structured and arranged to be utilized with a rotary tool to allow the user to more efficiently and effectively accomplish one or more work operations on a work object in a manner that substantially reduces the likelihood of causing damage to the work object. As such, the rotary bit of the present invention reduces the likelihood that the intended work operations on the work object will inadvertently cause damage that requires additional time to repair the damage or which may result in loss of the materials associated with the damaged work object. The improved rotary bit of the present invention is structured and arranged to be substantially form-following, which will allow the user to better perform the desired work operations on round, curved and other shaped surfaces of the work object with a rotary tool being less likely to cut, gouge, score or otherwise damage the shaped surfaces and surfaces adjacent to the shaped surfaces. The improved rotary bit of the present invention is structured and arranged to be utilized with a wide variety of different types of rotary tools and with a wide variety of conventional, commonly available grit paper and/or other abrasive materials. In a preferred configuration, the rotary bit of the present invention is relatively inexpensive to manufacture.

In one embodiment of the present invention, the improved rotary bit for accomplishing a work operation on a work object having one or more shaped surfaces generally comprises a mandrel that is secured to and rotated by the rotary tool, a flexible member that is attached to the mandrel and abrasive material on the flexible member that is selected so as to accomplish the desired work operation. The mandrel has an elongated shaft with a first end and a second end, with the first end being sized and configured to be secured to the rotary tool and rotated thereby. The flexible member has a compressible body with a proximal end and a distal end, with the proximal end being attached to the second end of the elongated shaft. The material for the compressible body is selected so as to allow the distal end of the compressible body to flex as the rotary bit is moved across the shaped surfaces of the work object to substantially prevent damage to the shaped surface and to any areas that are adjacent to the shaped surfaces. The abrasive material, which is typically associated with grit paper, is placed at or near the distal end of the compressible body. In one embodiment, the flexible member of the rotary bit is fixedly attached to the second end of the elongated shaft. In another embodiment, the flexible member is removably attached to the second end of the elongated shaft with a connecting mechanism comprising either a threaded member connecting to an aperture associated with the flexible member or a threaded member that connects to socket. In another embodiment, the rotary bit has a base member that is attached to either the elongated shaft or the flexible member that is configured to support the socket of the connecting mechanism. The compressible body is made from a closed cell foam material, silicone, rubber, composites or other materials that provide the desired flexibility. In a preferred embodiment, the compressible body has one or more grooves between the proximal end and the distal end thereof that are sized and configured to increase the flexibility of the flexible member. The compressible body can have one or more cored areas, alone or in addition to the grooves, that are also sized and configured to increase the flexibility of the flexible member. In one embodiment, the grit paper, or abrasive material if applied alone, is sized and configured to define a buffer area at the distal end of the compressible body to further reduce the likelihood of damage to the work object. The grit paper can be fixedly attached to the compressible body or it can be removably attached to the compressible body with a securing mechanism, such as a hook and loop material like VELCRO® or the like.

Accordingly, the primary aspect of the present invention is to provide an improved rotary bit for use with rotary tools that has the advantages discussed above and which overcomes the various disadvantages and limitations associated with prior art rotary bits utilized with such rotary tools.

It is an important aspect of the present invention to provide a rotary bit for use with rotary tools that is structured and arranged to reduce the likelihood of damaging a work object when the rotary tool is being utilized to accomplish work operations, such as grinding, sanding, buffing and the like, on the work object.

It is also an important aspect of the present invention to provide an improved rotary bit for use on rotary tools that is structured and arranged to allow the user to utilize commonly available rotary tools to improve the efficiency and effectiveness of accomplishing a wide variety of work operations on a work object while reducing the likelihood that those operations will damage the work object, which is likely to result in loss of time and/or material.

It is also an important aspect of the present invention to provide an improved rotary bit for use on rotary tools that allows the user to grind, sand, buff and accomplish other work operations on the round, curved and other shaped surfaces of a work object while significantly reducing the likelihood that those operations will cut, gouge, score or otherwise damage the shaped surfaces and the surfaces adjacent to the shaped surfaces.

It is also an important aspect of the present invention to provide an improved rotary bit for use on rotary tools that is structured and arranged to be utilized with a wide variety of different types of rotary tools and with commonly available conventional grit paper and other abrasive materials.

Another important aspect of the present invention is to provide an improved rotary bit for use on rotary tools to grind, sand and buff a work object that is relatively inexpensive to manufacture.

The above and other aspects of the present invention are explained in greater detail by reference to the attached figures and to the description of the preferred embodiments which follows. As set forth herein, the present invention resides in the novel features of form, construction, mode of operation and combination of the above presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

With reference to the figures where like elements have been given like numerical designations to facilitate the reader's understanding of the present invention, the preferred embodiments of the present invention are set forth below. The enclosed text and drawings are merely illustrative of one or more preferred embodiments and, as such, disclose one or more different ways of configuring the present invention. Although specific components, materials, configurations and uses are illustrated, it should be understood that a number of variations to the components and to the configuration of those components described herein and in the accompanying figures can be made without changing the scope and function of the invention set forth herein. For instance, although the figures and description provided herein show certain shapes and configurations and describe certain materials for the various components of the rotary bit, rotary tool and work object, those skilled in the art will understand that these are shown merely for exemplary purposes and to simplify this disclosure and that the rotary bit of the present invention is not so limited.

Figure 1:
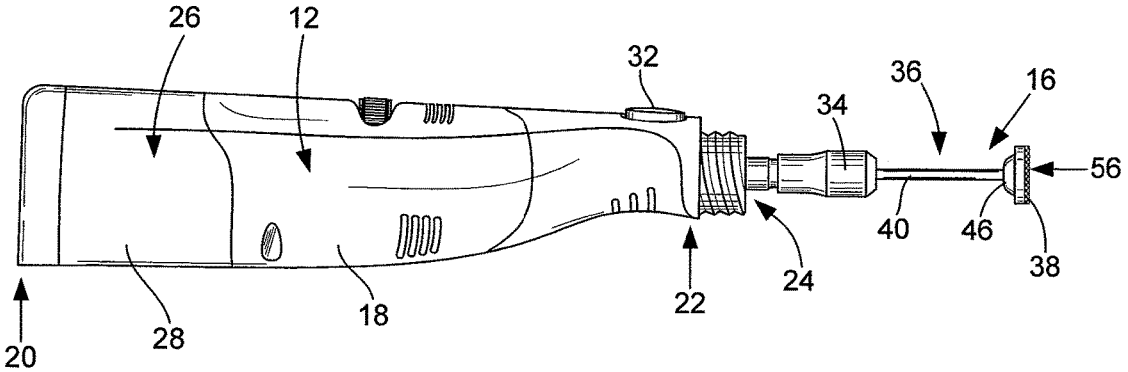
FIG. 1 (PRIOR ART)
FIG. 1 is a side view of a first embodiment of a prior art rotary bit shown attached to one embodiment of a prior art rotary tool, which is shown to exemplify the type of rotary tool that can be utilized with the rotary bit of the present invention.
Figure 2:
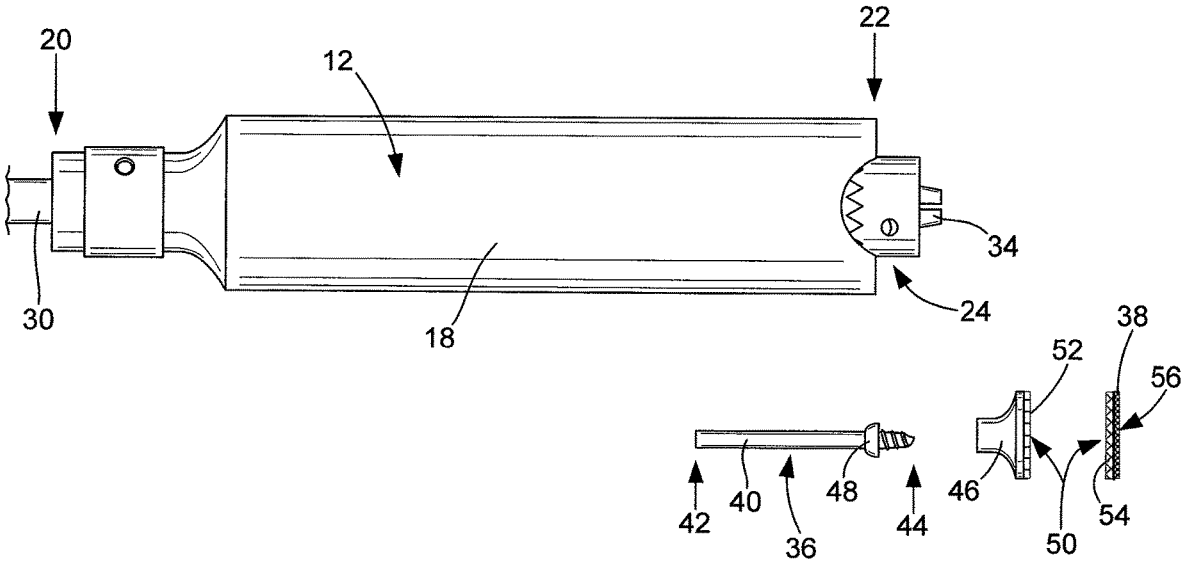
FIG. 2 (PRIOR ART)
FIG. 2 is an exploded side view of a second embodiment of a prior art rotary bit shown attached to another embodiment of a prior art rotary tool, which is also shown to exemplify the type of rotary tool that can be utilized with the rotary bit of the present invention.
Figure 3:
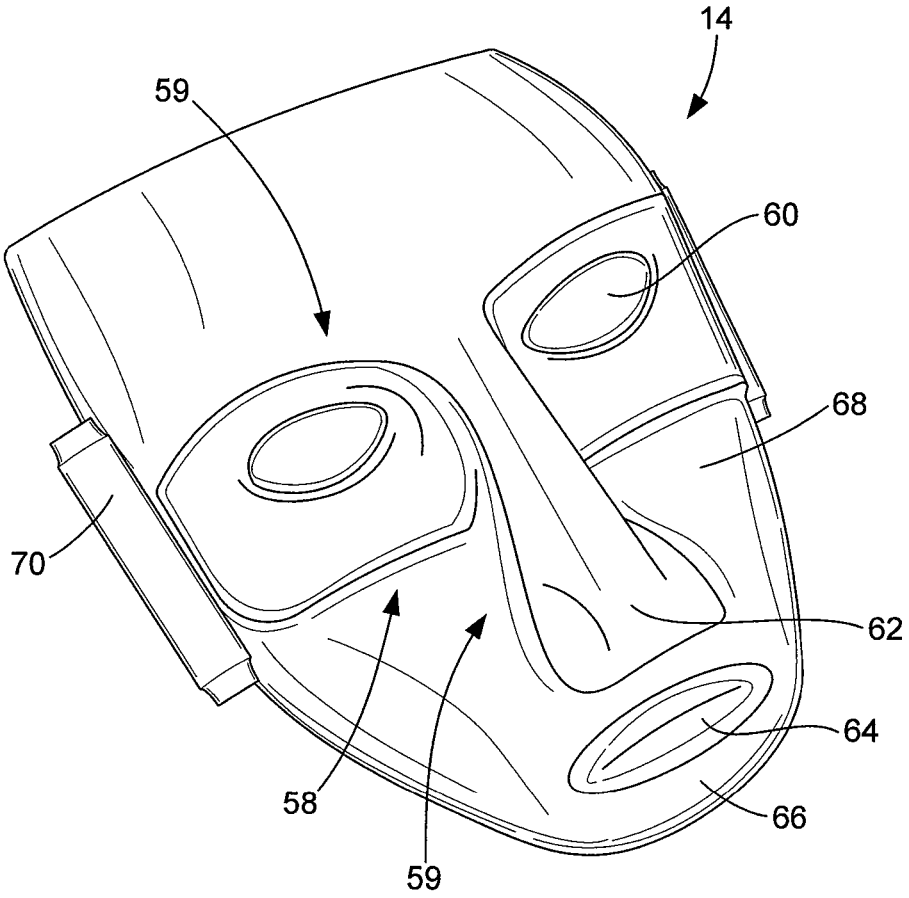
FIG. 3 is a front perspective view of a prior art work object that is shown to exemplify the type of work object for which the rotary bit of the present invention can be utilized to accomplish one or more work operations thereon.
Figure 4:
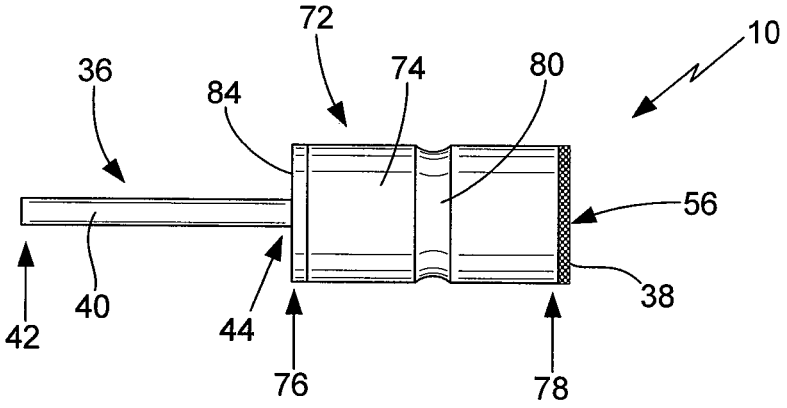
FIG. 4 is a side view of a rotary bit configured according to a first embodiment of the present invention with the mandrel and grit paper fixedly attached to the flexible member.

A rotary bit that is configured pursuant to various embodiments of the present invention is shown generally as 10 in FIGS. 4-11. As described in more detail below, the rotary bit 10 of the present invention is structured and arranged to be attached to and utilized with a rotary tool 12, prior art examples of which are shown in FIGS. 1 and 2, to accomplish one or more work operations on a work object 14, an example of which is shown in FIG. 3. As will be readily understood by persons who are skilled in the art, the various rotary power tools 12, work objects 14 and materials that are shown, described and/or referred to herein are included for exemplary purposes only and are not intended to limit the scope of the present invention. Examples of the rotary tools 12 which the rotary bit 10 of the present invention can attach include commonly available tools, such as the Dremel rotary tool shown in FIG. 1 and the Foredom rotary tool shown in FIG. 2. These types of rotary tools 12 are typically sized and configured to be held in the user's hand, although they may be supportedly mounted, and are configured to rotate an accessory item attached thereto, such as the prior art rotary bits 16 shown in FIGS. 1 and 2, to grind, sand, buff or accomplish other work operations.

As will be readily understood by those skilled in the art, rotary tool 12 generally comprises a tool body 18 that encloses a motor (not shown) that is sized and configured to perform the tasks normally associated with rotary tool 12. The rotary tool 12 has a first end 20 and a second end 22 with a rotating assembly 24 generally at the second end 22 and a source of power 26 at or near the first end 20, with the motor being disposed inside the rotary power tool body 18 between the first 20 and second 22 ends of the rotary tool 12. The source of power 26 may be a rechargeable battery pack 28 (as shown in FIG. 1), a power cord 30 (as shown in FIG. 2) configured to connect a supply of AC power, such as an outlet or the like, or pneumatic connector (not shown) that is configured to connect to a supply of pressurized air, as may be suitable to provide power for the motor of rotary tool 12. Depending on the type of rotary tool 12 other sources of power 26 may be utilized to power the rotary tool 12 and, therefore, rotate the rotary bit 10. Although the foregoing specific sources of power 26 are described and shown herein, this is merely for exemplary purposes as the present invention is not so limited. The source of power 26 provides power to the motor, whether electric powered, air powered or powered by other means, which is operatively connected to the rotating assembly 24 to rotate rotary bit 10 and accomplish one or more work operations. Typically, the rotary tool 12 has an on/off switch 32 that initiates rotation of the rotating assembly 24. The configuration and use of such prior art rotary tools 12, which are well known to those skilled in the art, is to rotate a prior art rotary bit 16 to perform a work operation, such as rotary cutting, sanding, sharpening, polishing and the like, on a work object 14.

The rotating assembly 24 of the typical rotary tool 12 has a chuck 34, such as shown in FIGS. 1 and 2, that is configured to removably receive a mandrel 36 that supports the abrasive material 37, typically applied as grit paper 38, that is utilized to accomplish the desired work operations on work object 14. The typical mandrel has an elongated shaft 40 with a proximal or first end 42 that is sized and configured to be received into the chuck 34 and a distal or second end 44 that has a mandrel head 46 to which grit paper 38 is either fixedly or removably attached, as shown in FIGS. 1 and 2. In the embodiment of FIG. 2, the mandrel head 46 is removably attached to the second end 44 of the shaft 40, typically by the threaded second end 44 being received into mandrel head 46. A stop member 48, shown in FIG. 2, is commonly utilized to abut against the mandrel head 46 when the mandrel head 46 is in the proper position. As well known in the art, the chuck 34 defines an aperture that is opened to receive the first end 42 or the shaft 40 of mandrel 36 and is closed to secure the mandrel 36, and therefore the rotary bit 16, to the rotary tool 12. The configuration and use of chucks 34 are well known in the art. Some rotating assemblies 24 utilize a collet or other type of collar to open and close the aperture around the shaft 40 of the rotary bit 16 to be rotated by the rotary tool 12. As will be set forth in more detail below, the chuck 34 of the rotary tool 12 is also utilized to secure the rotary bit 10 of the present invention to the rotary tool 12 to allow the user to accomplish the desired work operations. Although certain types of rotating assemblies 24 and chucks 34 are shown in the figures, those skilled in the art will readily appreciate that the rotary tools 12 which may be utilized with the rotary bit 10 of the present invention may have a wide variety of different configurations.

As well known in the art, the grit paper 38 can be fixedly attached to the mandrel head 46, as shown in FIG. 1, or removably attached to the mandrel head 46, as shown in FIG. 2. To removably attach the grit paper 38 to mandrel head 46, a securing mechanism 50 is utilized. In the embodiment shown in FIG. 2, the securing mechanism 50 is a hook and loop material, such as VELCRO® or the like, with the hook material 52 shown attached to the mandrel head 46 and the loop material 54 attached to the grit paper 38. As will be readily appreciated by those skilled in the art, the materials 52/54 may be reversed and other types of securing mechanisms 50 may be utilized to removably secure the grit paper 38 to mandrel head 46. The grit paper 38 generally comprises a heavy backing paper with an abrasive material that is attached or embedded to one surface of the paper to form the abrasive outward face 56 of grit paper 38. As set forth above, the abrasive materials associated with grit paper 38 are provided in a variety of different sizes, commonly referred to as grit size or designation, and are typically intended to accomplish different results when worked against the work material 14.

The rotary bit 10 of the present invention is particularly structured and arranged for use with a work object 14 having a variety of round, curved or other shaped surfaces 58, such as shown in the example object of FIG. 3. As set forth in the Background section and well known in the art, the prior art rotary bits 16 are stiff and inflexible with regard to the contact between the grit paper 38 on the prior art rotary bit 16 and the work object 14, which creates problems with cutting, gouging, scoring and other damage to the work object 14 on or around the shaped surfaces 58. As a result of these potential problems, people who create or work with work objects typically sand, sharpen, buff or polish the shaped surfaces 58, and the areas adjacent to the shaped surfaces 58 (which are hereinafter referred to as the "adjacent areas" 59) by hand with grit paper 38. Although performing these work operations by hand significantly increases the amount of time to accomplish these tasks, most people prefer this approach in light of the potential of damaging the work object 14 that can be caused by using the prior art rotary bit 16. In contrast, as set forth in more detail below, the rotary bit 10 of the present invention provides flexibility for the contact between the grit paper 38 and work object 14 to substantially reduce the likelihood of damaging the work object 14 when using the rotary bit 10 with a rotary tool 12 to accomplish the various work operations.

In the embodiment shown in FIG. 3, the work object 14 has a variety of shaped surfaces 58 that form and are around the eyes 60, nose 62, mouth 64, chin 66, cheeks 68 and ears 70 of the human-like face that defines the work object 14 shown in FIG. 3 (which is used for exemplary purposes only). As will be readily appreciated by persons skilled in the art, the movement of the rotating grit paper 38, attached to prior art rotary bit 16 and rotated by rotary tool 12, must be carefully controlled by the user of the rotary tool 12. Unfortunately, even if he or she is very careful while going over or near the shaped surfaces 58, the grit paper 38 can cut, gauge, score or do other damage to the shaped surfaces 58 or adjacent areas 59. Although the user may be able to sand, buff, polish or otherwise repair any areas that are damaged by use of prior art rotary bit 16, such repairs will take additional time and may result in changes (i.e., re-shaping) to the shaped surface 58. If the damage is too much or alters the shaped surface 58 or adjacent areas 59 to an undesirable extent, then the user may have to discard the damaged work object 14, which can result in total loss of the time and materials associated with the unfinished work object 14. Besides the fact that the loss of time and/or materials that were invested in working on the work object 14 would be discouraging to the user, the lost time and material can be quite expensive.

The rotary bit 10 of the present invention generally comprises the mandrel 36, abrasive material 37 and grit paper 38, as they may be differently configured for rotary bit 10, of the prior art rotary bits 16. However, as shown in FIGS. 4-11, the improved rotary bit 10 of the present invention also comprises a flexible member 72 that is disposed between the mandrel 36 and the grit paper 38. The flexible member 72 comprises a compressible body 74 having a first or proximal end 76 that, when attached to mandrel 36, is positioned generally at or towards the second end 44 of elongated shaft 40 and a second or distal end 78 that extends outwardly from the shaft 40. The grit paper 38 is fixedly or removably attached to the distal end 78 of the compressible body 74. As set forth in more detail below, the compressible body 74 of the flexible member 72 is selected and configured to be sufficiently stiff to allow pressure to be applied against the work object 14 but also sufficiently compressible so that the compressible body 74 will flex to allow the rotary bit 10 to be at least substantially form-following, as shown in FIG. 11 where the rotary bit 10 is shown moving along a work object 14 having shaped surfaces 58, when the rotary bit 10 is moved along work object 14 by the rotary tool 12. Because the rotary bit 10 of the present invention will substantially follow the form of the work object 14, the abrasive material 37 or grit paper 38 will grind, sand, buff or otherwise work the shaped surfaces 58 without damaging the shaped surfaces 58 or the adjacent areas 59.

Figure 12:
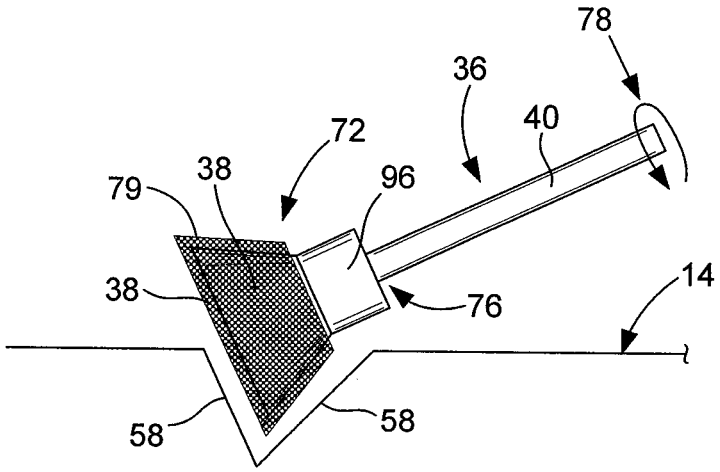
FIG. 12 is a side view a rotary bit configured according to a sixth embodiment of the present invention shown in use to perform a work operation the shaped surface of a work object.
Figure 13:
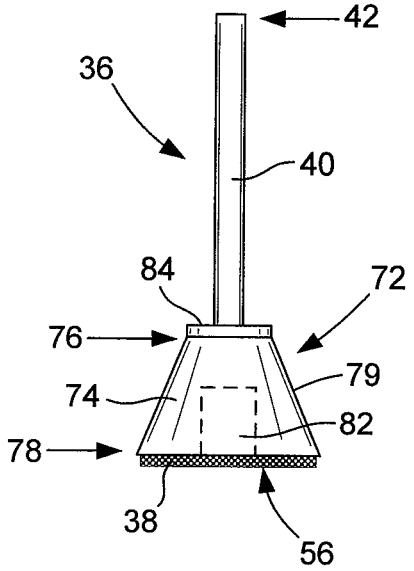
FIG. 13 is a side view of a rotary bit configured according to a seventh embodiment of the present invention showing use of an angled compression body having a cored area therein.

The compressible body 74 of the flexible member 72 can be made out of a variety of materials or combination of materials. The material for compressible body 74 should be selected to allow the flexible member 72 to flex, however it must also be able to withstand the rotation from the rotary tool 12 as it is pressed against the work object 14. In one embodiment of the rotary bit 10 of the present invention, the compressible body 74 is made from a closed cell foam material that will flex, as shown in FIG. 11, enough to allow the grit paper 38 to follow the contours of the shaped areas 58 and move along the adjacent areas 59 without damaging either area 58/59. In an alternative embodiment, the compressible body 74 can be made out of silicone. Rubber and composite materials may also be suitable for use for compressible body 74. The material of the compressible body 74 must have sufficient density or inflection resistance to allow the user to press the distal end 78 against the work object 14 without the flexible member 72 twisting or turning so much it collapses and fails to be able to provide the necessary stiffness for the abrasive material 37, whether alone or in the form of grit paper 38, to accomplish the user's intended work operation, such as grinding, sanding, buffing or the like. Although a variety of shapes may be suitable for the compressible body 74 of the flexible member 72, in a preferred embodiment it has a generally cylindrical shape, as shown in FIGS. 4-11. Alternatively, the flexible member 72 can have the shape shown in FIGS. 12 and 13 with one or more slanted sidewalls 79. In FIG. 12, the slanted sidewalls 79 are also, in addition to the distal end 78, covered with abrasive material 38. This type of configuration is likely to be useful for performing a work operation on a sharply angled shaped surface 58, shown in FIG. 12, of the work object 14. In the embodiment of FIG. 13, the proximal end 76 of the compressible body 74 with the slanted sidewalls 79 is supportedly connected to the second end 44 of the elongated shaft 40.

Figure 5:
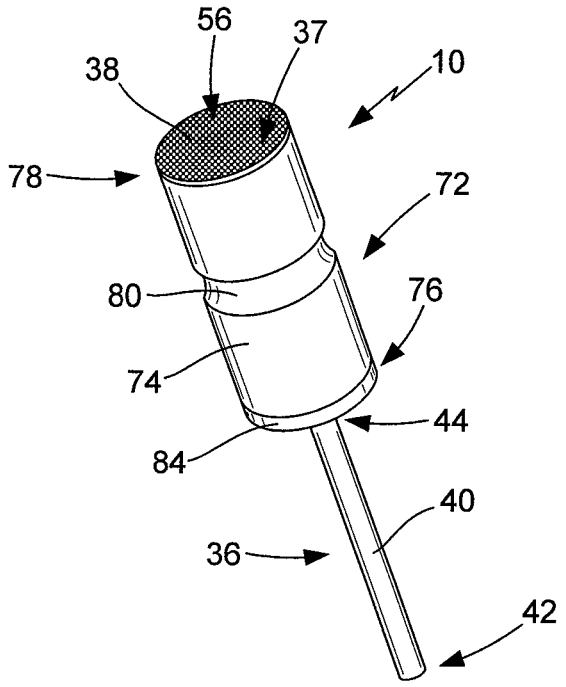
FIG. 5 is a side perspective view of the rotary bit of FIG. 4 showing the grit paper affixed to the second or distal end of the flexible member.
Figure 6:
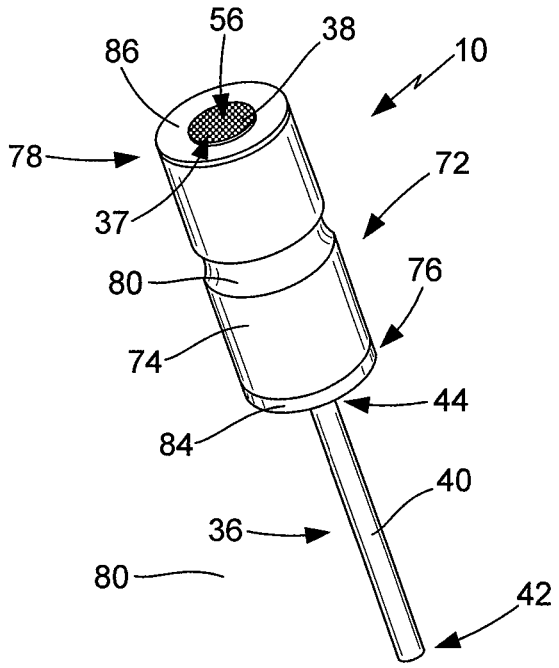
FIG. 6 is a side perspective view of a different configuration of the rotary bit of FIG. 4 with the grit paper at the first end of the flexible member being configured to provide a buffer area.
Figure 7:
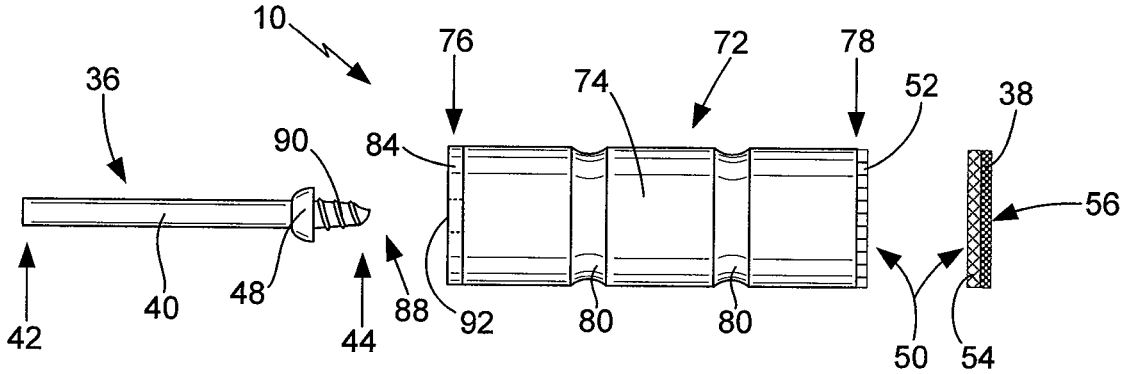
FIG. 7 is an exploded side view of a rotary bit configured according to a second embodiment of the present invention with the mandrel and grit paper being removably attached to the flexible member.
Figure 8:
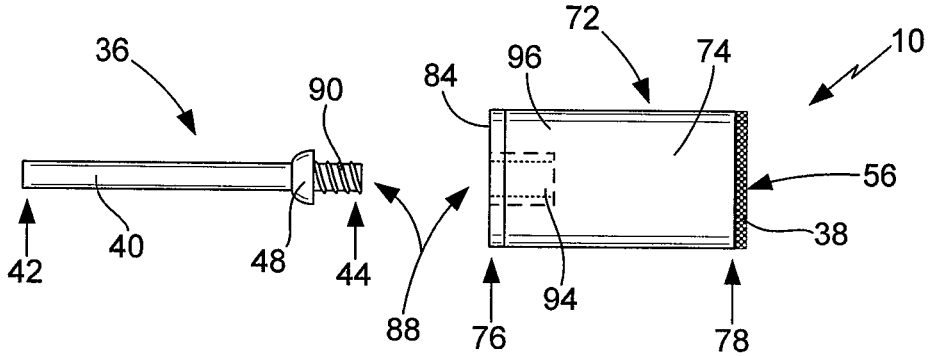
FIG. 8 is an exploded side view of a rotary bit configured according to a third embodiment of the present invention with the mandrel being removably attached to the flexible member.
Figure 9:
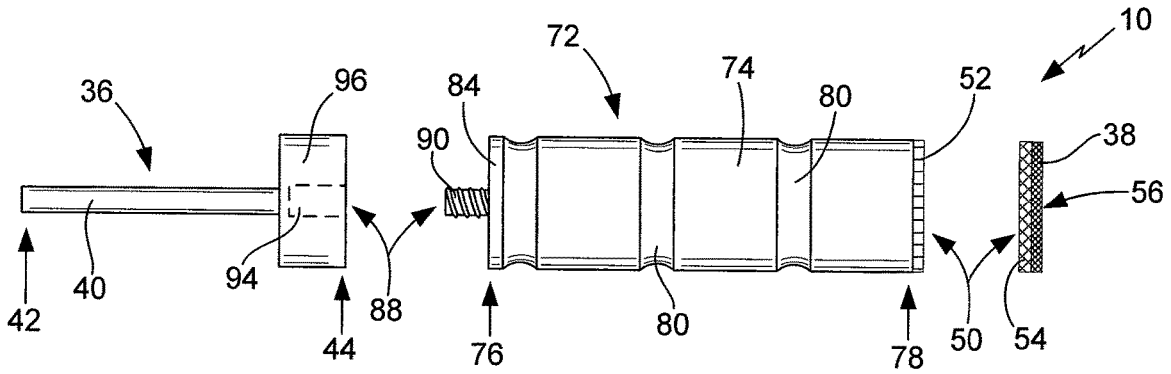
FIG. 9 is an exploded side view of a rotary bit configured according to a fourth embodiment of the present invention with the mandrel and grit paper being removably attached to the flexible member.
Figure 10:
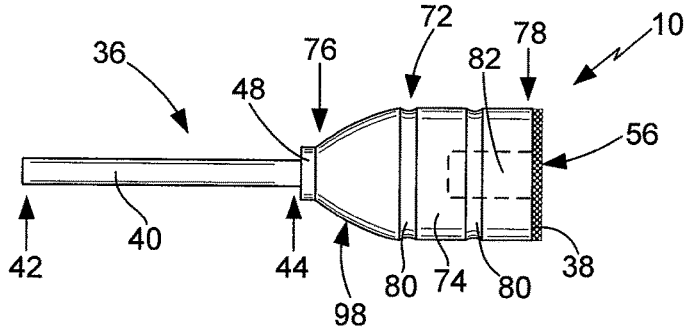
FIG. 10 is a side view of a rotary bit configured according to a fifth embodiment of the present invention with the mandrel and grit paper being fixedly attached to the flexible member and the flexible member having an angled section.
Figure 11:
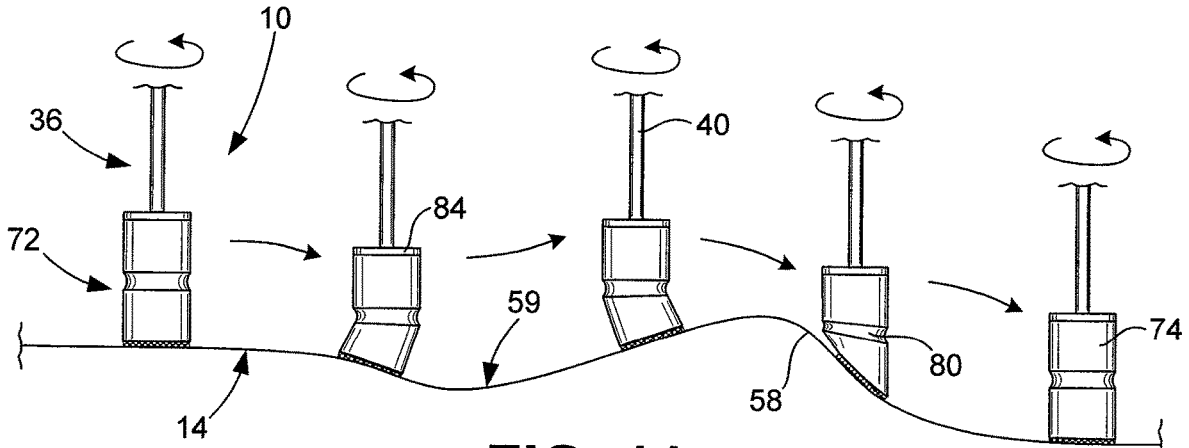
FIG. 11 is a side movement progression view of the rotary bit of FIG. 4 as it moves across shaped surfaces of a work object to show how the flexible member of the rotary bit of the present invention is form-following when in use to perform a work operation on the work object.

To control and/or improve the flexibility of the flexible member 72, the compressible body 74 can have one or more grooves 80 disposed between the proximal end 76 and the distal end 78 thereof, as shown in FIGS. 4-7 and 9-11. In the embodiment of FIGS. 4-6 and 11, the compressible body 74 comprises a single groove 80 at or near the mid-point between the proximal end 76 and the distal end 78. In the embodiments of FIGS. 7, 9 and 10, the compressible body 74 has two grooves disposed between the ends 76/78 of compressible body 74. If desired, the compressible body 74 may have more than two grooves 80 or, as shown in FIG. 8, no grooves 80. Preferably, the grooves 80 are disposed entirely around the entire perimeter of the compressible body 74 so the flexible member 72 will flex relatively evenly as the rotary bit 10 moves along the work object 14. The grooves 80 can have a variety of different shapes and configurations (i.e., smoothly cut, sharp v-cut or the like) and widths that are sufficient to provide the desired amount of additional flex motion for the flexible member 72 to achieve the purposes and objectives of the present invention. Likewise, the grooves 80 can be placed on compressible body 74 at various places between the proximal end 76 and distal end 78 as may be suitable to achieve the desired amount of flex action for flexible member 72.

Figure 14:
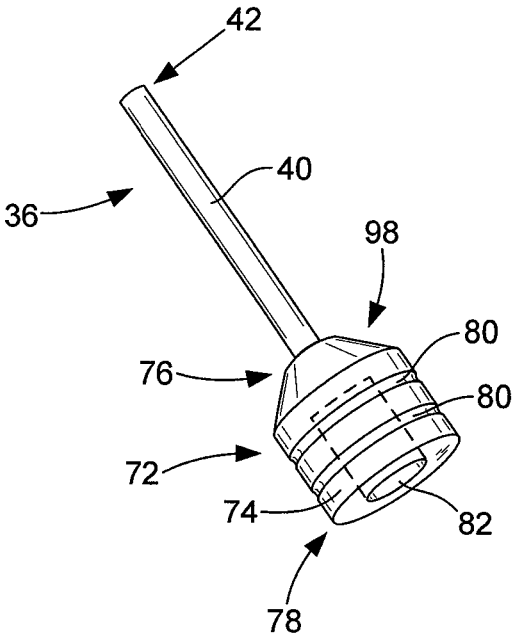
FIG. 14 is a side perspective view of the rotary bit of the present invention shown without the abrasive material at the first end to better show the cored area thereof.

In the embodiments of FIGS. 10, 13 and 14, the compressible body 74 has been modified to include a cored area 82 that, like the grooves 80, is sized and configured to provide additional flexibility, as may be needed depending on the material, size and etc., so that the rotary bit 10 will move the grit paper 38 along the contours of the shaped areas 58 without damaging the shaped areas 58 or the adjacent areas 59. Cored area 82 may be placed into or through the longitudinal center of the compressible body 74, as shown in FIGS. 10, 13 and 14, or there may be one or more cored areas 82 that are positioned elsewhere (i.e., the sides) on compressible body 74 between the ends 76/78 thereof. The cored areas 82 may pass entirely through the compressible body 74, only partially extend into the compressible body 74 or be disposed entirely inside the compressible body 74 (i.e., no entrance or exit opening). As will be readily appreciated by persons skilled in the art, various factors with regard to the compressible body 74 itself, including material(s), width, length and the like of compressible body 74, will affect how many grooves 80 and/or cored areas 82 are beneficial to achieve the desired amount of flexibility. As will also be readily appreciated by such persons, it is likely that experimentation will be required to achieve the desired amount of flexibility with regard to the size, shape, placement and number of grooves 80 and/or cored areas 82, if any such flexible features are utilized with rotary bit 10.

As an alternative to or in addition to the grooves 80, the compressible body 74 of the flexible member 72 can comprise one or more sections that are made out of different material than the remaining portion(s) of the compressible body 74 to provide the desired degree of flexibility for the flexible member 72. The size and number of these section(s) of different materials can be selected to affect the amount of flexibility of flexible member 72. Likewise, although it is likely to be preferred to have the cored area(s) 82 of the compressible body 74 to be empty due to the cost of manufacturing the rotary bit 10, in an alternative embodiment the cored area(s) 82 may be filled with a gel or other material to affect, whether less or more, the flexibility of the flexible member 72. As with the grooves 80 and cored areas 82 themselves, the use of different materials in the compressible body and filling of the cored areas 82 with gel or the like will likely require experimentation to obtain the desired amount of flexibility for flexible member 72.

The relationships between the mandrel 36 and/or the grit paper 38 and the flexible member 72 may have a wide variety of different configurations. For instance, in the embodiments of FIGS. 4-6 and 11, the proximal end 76 of the compressible body 74 is fixedly attached to the second end 44 of the shaft 40 of mandrel 36, via a stiff, hard cap member 84 at the proximal end 76. Also in these embodiments of the rotary bit 10, as with the embodiment FIG. 10, the grit paper 38 may be fixedly attached to the distal end 78 of compressible body 74 utilizing adhesives or the like. Alternatively, as shown in FIG. 8, the abrasive material 37 may be integral with or applied to the distal end 78 of the compressible body 74 by embedding or otherwise fixing the abrasive material 37 directly to the distal end 78 of the compressible body 74. Typically, however, it will be preferable to utilize commercially available grit paper 38 with the rotary bit 10 of the present invention. The grit paper 38, or the abrasive material 37 if integral or applied alone, can be applied across or over the entire surface of the distal end 78 of compressible body 74, as best shown in FIG. 5. Alternatively, the grit paper 38 or abrasive material 37 can be applied to just a portion, such as the center area as shown in FIG. 6, of the surface of the distal end 37 to provide a buffer area 86 that further reduces the likelihood of unintentionally cutting into work object 14 when grinding, sanding or buffing any of the shaped surfaces 58 and/or adjacent areas 59.

In the embodiments of FIGS. 7-10, the rotary bit 10 has a connecting mechanism 88 that removably attaches or releasably joins the mandrel 36 to the flexible member 72 by connecting the second end 44 of the shaft 40 of mandrel 36 to the proximal end 76 of the compressible body 74 of flexible member 72. In the embodiment of FIG. 7, the second end 44 of the elongated shaft 40 comprises a screw-like threaded end 90 that is sized and configured to be threadably received into an aperture 92 in the cap member 84 at the proximal end 76 of compressible body 74 of flexible member 72. This configuration is also in use with the prior art rotary tool 16. As set forth above, the stop member 48 prevents the shaft 40 from going too far into compressible body 74. In the embodiment of FIG. 8, connecting mechanism 90 comprises a bolt-like threaded member 90 at the second end 44 of elongated shaft 40 that is sized and configured to be threadably received into a socket 94 disposed inside a base member 96 positioned at the proximal end 76 of the compressible body 74 of flexible member 72, which extends through the cap member 84 and into the base member 96. If desired, a second cap member 94 can be utilized to connect the base member 96 to the compressible body 74. In another embodiment, not shown, the base member 96 is not utilized. Instead, the threaded member 90, cap member 84 and socket 94 are each cooperatively sized and configured such that threaded member 90 only engages the cap member 84 and does not extend into the compressible body 74. In the embodiment of FIG. 9, connecting mechanism 90 comprises a bolt-like threaded member 90 at the proximal end 76 of compressible body 74, extending outwardly from cap member 84, that is sized and configured to be threadably received into a socket 94 inside a base member 96 at the second end 44 of elongated shaft 40. The cap member 84 of flexible member 92 should be made out of a material that is sufficiently rigid to provide stiffness support for compressible body 74 when in use to grind, sand, buff and polish the work object 14. Likewise, the base member 96 of the embodiments shown in FIGS. 8 and 9 should be sufficiently stiff to receive the threaded member 90 into the socket 94. Preferably, the cap member 84 and the base member 96 are made out of a material that is not likely to scratch or otherwise harm the work object 14 if they come into contact with the work object 14.

As set forth above with the prior art rotary bit 16, the grit paper 38 can be fixedly attached to the mandrel head 46 of the rotary bit 10, as shown in FIGS. 4-6 and 10-11, or the grit paper can be removably attached to the mandrel head 46, as shown in FIGS. 7 and 9. To removably attach the grit paper 38 to mandrel head 46, a securing mechanism 50 is utilized. In the embodiments set forth in FIGS. 7 and 9, the securing mechanism 50 is a hook and loop material, such as VELCRO® or the like, with the hook material 52 shown attached to the mandrel head 46 and the loop material 54 attached to the grit paper 38. As will be readily appreciated by those skilled in the art, the materials 52/54 may be reversed and other types of securing mechanisms 50, such as screws, bolts, snaps and the like, may be utilized to removably secure the grit paper 38 to mandrel head 46. As set forth above, the grit paper 38 generally comprises a heavy backing paper with an abrasive material 37 that is attached or embedded to one surface of the paper to form the abrasive outward face 56 of grit paper 38. As set forth above, the abrasive materials 37 associated with grit paper 38 are provided in a variety of different sizes, commonly referred to as grit size or designation, and are typically intended to accomplish different results (i.e., grinding, sanding, buffing and polishing) when worked against the surface of the work material 14. If desired, the grit paper 38 or the abrasive materials 37 can be applied to one or more sides of the compressible body 74 in addition to or instead of the distal end 78 thereof.

In the embodiment of FIG. 10, the compressible body 74 of flexible member 72 comprises an angled section 98 that is provided for ease of grinding, sanding, buffing, polishing or accomplishing other work operations under folds or other over-hanging shaped surfaces 58. In the embodiment shown in FIG. 10, the angled section 98 is at or near the proximal end 76 of the compressible body 74 and not utilize a cap member 84. Those skilled in the art will readily appreciate that the angled section 98 can be positioned at or near the distal end 78 of the compressible body 74. The angled section 98 can have a variety of different size and shape configurations.

In use, the first end 42 of the elongated shaft 40 of the rotary bit 10 of the present invention is placed in the chuck 34 of the rotary tool 12 and secured thereto as may be appropriate for the rotary tool 12. When powered, the rotating assembly 24 of the rotary tool 12 will rotate the rotary bit 10. The user places the abrasive face 56 of the abrasive material 37 at the distal end 78 of compressible body 74, whether part of a grit paper 38 or directly applied to the distal end 78 of the compressible body 74, against the surface of the work object 14 and performs the desired work operation. Unlike prior art rotary bits 16, the rotary bit 10 of the present invention will at least slightly compress as a result of the user pressing the flexible member 72 against the work object 14. As the user moves the rotary bit 10 across shaped surfaces 58 of the work object 14, the compressible body 74 of the flexible member 72 will flex, as shown in FIG. 11, to better direct the abrasive face 56 against the shaped work object 14 without cutting, gouging, scoring and causing other damage to the shaped surfaces 58 or adjacent areas 59 of work object 14. In the embodiment with the replaceable grit paper 38, the user can replace the grit paper 38 as need or necessary. In the other embodiments, the user will have to replace either the entire rotary bit 10 or the flexible member 72 to change out the adhesive material 37 at the distal end 78 of the compressible body 74. Likewise, the user can change out the rotary bit 10, or as applicable just the flexible member 72, when a different degree of flexibility is desired for the work operations he or she will be performing.

As will be readily appreciated by persons skilled in the art, use of the rotary bit 10 of the present invention allows the user to have the benefits of using a powered rotary tool 10 to accomplish certain work operations, including reduced time for performing the work operations, while reducing the likelihood that the work operations will inadvertently cause damage to the work object 14 that will require additional time for the user to repair or which may result in loss of the materials associated with the damaged work object 14. Because the rotary bit 10 of the present invention is structured and arranged to be substantially form-following, the user will be able to better perform the desired work operations on round, curved, contoured and other shaped surfaces 58 of the work object 14 while being much less likely to cut, gouge, score or otherwise damage the shaped surfaces 58 and the adjacent areas 59. The rotary bit 10 can be utilized with a wide variety of different types of rotary tools 12 and with a wide variety of conventional, commonly available grit paper 38 or abrasive materials 37. The rotary bit 10 of the present invention will provide more effective use of the abrasive materials 37 and/or the grit paper 38. As will be readily appreciated by persons skilled in the art, the rotary bit 10 of the present invention will be relatively inexpensive to manufacture, thereby providing a reasonably cost rotary bit 10 that will provide the various benefits and accomplish the objectives set forth above.

While there are shown and described herein a specific form of the invention, it will be readily apparent to those skilled in the art that the invention is not so limited, but is susceptible to various modifications and rearrangements in design and materials without departing from the spirit and scope of the invention. In particular, it should be noted that the present invention is subject to modification with regard to any dimensional relationships set forth herein and modifications in assembly, materials, size, shape and use. For instance, there are numerous components described herein that can be replaced with equivalent functioning components to accomplish the objectives of the present invention.

What is claimed is:

1. A rotary bit for use with a rotary tool to accomplish a work operation on a work object having one or more shaped surfaces, said rotary bit comprising:

a mandrel having an elongated shaft with a first end and a second end, said first end sized and configured to be secured to the rotary tool and rotated thereby;

a flexible member having a compressible body with a proximal end and a distal end, said proximal end attached to said second end of said elongated shaft, the material for said compressible body selected so as to allow said distal end of said compressible body to compress and flex across the entire width of said compressible body as said rotary bit is moved across the shaped surface of the work object to substantially prevent damage to the shaped surface and to any adjacent areas thereof; and an abrasive material at or near said distal end of said compressible body, said abrasive material selected so as to accomplish the work operation.

2. The rotary bit of claim 1, wherein said flexible member is fixedly attached to said second end of said elongated shaft.

3. The rotary bit of claim 1, wherein said flexible member is removably attached to said second end of said elongated shaft.

4. The rotary bit of claim 3 further comprising a connecting mechanism configured to removably connect said flexible member to said elongated shaft.

5. The rotary bit of claim 4, wherein said connecting mechanism comprises a threaded member on one of said second end of said elongated shaft and said proximal end of said compressible member and a socket sized and configured to threadably receive said threaded member on one of said second end of said elongated shaft and said proximal end of said compressible member.

6. The rotary bit of claim 5 further comprising a base member attached to one of said elongated shaft and said flexible member, said base member configured to support said socket.

7. The rotary bit of claim 1, wherein said compressible body is made from a closed cell foam material.

8. The rotary bit of claim 1, wherein said compressible body is made from silicone.

9. The rotary bit of claim 1, wherein said compressible body has one or more grooves disposed between said proximal end and said distal end thereof, said grooves being sized and configured to cut into said compressible body so as increase the flexibility of said flexible member.

10. The rotary bit of claim 1, wherein said compressible body has one or more cored areas, said cored areas being sized and configured to increase the flexibility of said flexible member.

11. The rotary bit of claim 1, wherein said abrasive material is sized and configured to define a buffer area at said distal end of said compressible body.

12. The rotary bit of claim 1, wherein said abrasive material is on a grit paper, said grit paper secured to said compressible body of said flexible member.

13. The rotary bit of claim 12 further comprising a securing means interconnecting said grit paper and said compressible body for removably securing said grit paper to said compressible body.

14. A rotary bit for use with a rotary tool to accomplish a work operation on a work object having one or more shaped surfaces, said rotary bit comprising:

a mandrel having an elongated shaft with a first end and a second end, said first end sized and configured to be secured to the rotary tool and rotated thereby;

a flexible member having a compressible body with a proximal end and a distal end, said proximal end attached to said second end of said elongated shaft, the material for said compressible body selected so as to allow said distal end of said compressible body to compress and flex across the entire width of said compressible body as said rotary bit is moved across the shaped surface of the work object to substantially prevent damage to the shaped surface and to any adjacent areas thereof;

a cap member at said proximal end of said compressible body; and a grit paper having an abrasive material defining an abrasive face of said grit paper, said grit paper positioned at said distal end of said compressible body, said abrasive material selected so as to accomplish the work operation.

15. The rotary bit of claim 14 further comprising a connecting mechanism configured to removably connect said flexible member to said elongated shaft.

16. The rotary bit of claim 14, wherein said compressible body has one or more grooves disposed between said proximal end and said distal end thereof, said grooves being sized and configured to cut into said compressible body so as increase the flexibility of said flexible member.

17. The rotary bit of claim 14, wherein said compressible body has one or more cored areas, said cored areas being sized and configured to increase the flexibility of said flexible member.

18. The rotary bit of claim 14 further comprising a securing means interconnecting said grit paper and said compressible body for removably securing said grit paper to said compressible body.

19. A rotary bit for use with a rotary tool to accomplish a work operation on a work object having one or more shaped surfaces, said rotary bit comprising:

a mandrel having an elongated shaft with a first end and a second end, said first end sized and configured to be secured to the rotary tool and rotated thereby;

a flexible member having a compressible body with a proximal end, a distal end and a cap member at said proximal end, said proximal end attached to said second end of said elongated shaft, the material for said compressible body selected so as to allow said distal end of said compressible body to compress and flex across the entire width of said compressible body as said rotary bit is moved across the shaped surface of the work object to substantially prevent damage to the shaped surface and to any adjacent areas thereof;

one or more grooves disposed between said proximal end and said distal end of said compressible body, said grooves being sized and configured to cut into said compressible body so as increase the flexibility of said flexible member;

a grit paper having an abrasive material defining an abrasive face of said grit paper, said grit paper positioned at said distal end of said compressible body, said abrasive material selected so as to accomplish the work operation; and securing means interconnecting said grit paper and said compressible body for removably securing said grit paper to said compressible body.

20. The rotary bit of claim 19 further comprising a connecting mechanism configured to removably connect said flexible member to said elongated shaft.

* * * * *